US007271789B2

(12) United States Patent
Lee et al.

(10) Patent No.: US 7,271,789 B2
(45) Date of Patent: Sep. 18, 2007

(54) LIQUID CRYSTAL DISPLAY PANEL AND DRIVING METHOD THEREFOR

(75) Inventors: Seok Lyul Lee, Tao-Yuan Hsien (TW); Po Sheng Shih, Tao-Yuan Hsien (TW)

(73) Assignee: Hannstar Display Corporation, Taipei (TW)

( * ) Notice: Subject to any disclaimer, the term of this patent is extended or adjusted under 35 U.S.C. 154(b) by 568 days.

(21) Appl. No.: 10/790,824

(22) Filed: Mar. 3, 2004

(65) Prior Publication Data

US 2005/0083279 A1 Apr. 21, 2005

(30) Foreign Application Priority Data

Oct. 15, 2003 (TW) ..... 92128619 A

(51) Int. Cl.
*G09G 3/36* (2006.01)

(52) U.S. Cl. ..... 345/87; 345/204

(58) Field of Classification Search ..... 345/87–100, 345/204

See application file for complete search history.

(56) References Cited

U.S. PATENT DOCUMENTS 6,853,372 B2 * 2/2005 Kanzaki et al. ..... 345/208

2004/0046914 A1 * 3/2004 Hirota ..... 349/129

* cited by examiner

*Primary Examiner*—Richard Hjerpe
*Assistant Examiner*—Jean Lesperance
(74) *Attorney, Agent, or Firm*—Volentine & Whitt, PLLC

(57) ABSTRACT

A liquid crystal display panel includes an active matrix substrate having a plurality of thin film transistors. The active matrix substrate comprises a plurality of parallel scanning lines and a plurality of parallel data lines, which cross mutually and form a plurality of pixels. Each of the pixels includes the first thin film transistor, the second thin film transistor, a control electrode (CE) and a pixel electrode. The first electrode of the first thin film transistor is connected to the data line; the second electrode of it is connected to the pixel electrode; the gate electrode of it is connected to the scanning line. The first electrode of the second thin film transistor is connected to another adjacent data line; the second electrode of it is connected to the control electrode, and the gate of it is connected to another adjacent scanning line. The scanning signals driving the pixel allows the control electrode and the pixel electrode to be written into their potentials during two horizontal scanning periods or during a vertical scanning period respectively.

23 Claims, 5 Drawing Sheets

LIQUID CRYSTAL DISPLAY PANEL AND DRIVING METHOD THEREFOR

BACKGROUND OF THE INVENTION

1. Field of the Invention

The prevented invention relates to a liquid crystal display panel and a driving method therefor, especially relates to a liquid crystal display panel and its driving method, which makes the potential of a control electrode higher than the potential of a pixel electrode by increasing the number of thin film transistors.

2. Description of the Related Art

With the wide applications of liquid crystal display (LCD) panels, users have more and more demands about the quality of the LCD panel, such as high brightness, high contrast, high resolution, high color saturation and fast response time. Especially as the panel size increases, the LCD panels have generally been applied to household flat displays, such as liquid crystal (LC) TV sets, which have become an important application of the LCD panels. Most of the general, traditional LCD panels have narrow view angles so the normal images displayed by them only can be viewed directly in front of the display area. If we watch the display area from an oblique view angle, color distortion occurs in what we watch, and even gray inversion occurs. That is, what appears black is actually white and what appears white is actually black. Therefore, how to widen the view angle is an important subject for the LCD manufacturers.

Among various methods for widening the view angle, an LC Vertical Alignment (VA) technique is still one of the most popular techniques in the current LCD market. However, because liquid crystal molecules are aligned in the same direction (mono-domain vertical alignment), we also cannot see a normal image from the view angle perpendicular to or symmetric to the direction. No matter when the liquid crystal molecules are realigned in a different direction after the electrical field existing therein changes, the view angle is also limited to the parallel direction of the liquid crystal molecules. Therefore, a multi-domain VA technique was put forth to improve the drawback of the prior art, hence the quality of various view angles is assured. Japanese Fujitsu Corporation once tried to form ridges or bumps on the color filter, and use the oblique boundary generated by bumps to control the alignment of the tilt direction of liquid crystal molecules automatically align tilt direction according to where region their belong to. But because the existence of the bumps results in that the precise alignment between a color filter and an active matrix substrate is necessary, and an additional over coating is necessarily formed on the color filter, the yield of this LCD panel becomes worse and the cost thereof increases.

FIG. 1 is a cross-sectional diagram of a conventional LCD display panel with a bias-bending vertical alignment (BBVA) type. The LCD panel 110 comprises a color filter 11, a liquid crystal layer 12 and an active matrix substrate 13. The color filter 11 and active matrix substrate 13 have a transparent substrate 111 and 131 respectively. A main electric field exists between the common electrode 112 formed on the color filter 11 and the pixel electrode 134 formed on the active matrix substrate 13, and a pair of symmetrically oblique electric fields exists between a control electrode 133 and the pixel electrode 134 together formed on the active matrix substrate 13 to make liquid crystal molecules 121 have oblique positions. There is another insulation layer 132 interposed between the control electrode 133 and the pixel electrode 134.

But when $V_{CE}<V_{com}<V_P$ is satisfied, a declination line is brought into existence in the center of an area B, wherein $V_{CE}$, $V_{com}$ and $V_p$ represent the potentials of the control electrode, common electrode and pixel electrode respectively. The existence of the declination line result in that the liquid crystal layer 12 has a lower transmission ratio, a longer response time and an unstable status. In order to avoid the occurrence of these negative phenomena, it is expect that the following criteria should be satisfied during polarity inversion:

Criterion 1: If the current pixel is a positive frame, then $V_{CE}>V_p>V_{com}$; and Criterion 2: If the current pixel is a negative frame, then $V_{CE}<V_p<V_{com}$.

FIG. 2 is an equivalent circuit diagram of a pixel proposed by Korean Samsung Electronics Cooperation. The circuit of pixel 20 can satisfy aforesaid criteria to eliminate declination lines. One electrode of the first thin film transistor $T_1''$ is connected to a data line 262, and the gate electrode of it is driven by the scanning line 252. When the first thin film transistor $T_1''$ is turned on, the data signal of the data line 262 is written into a pixel electrode 24. One electrode of the second thin film transistor $T_2''$ is connected to a data line 261, and the gate electrode of it is driven by a scanning line 251. When the second thin film transistor $T_2''$ is turned on, the data signal of the data line 261 is written into a control electrode 23. One electrode of the third thin film transistor $T_3''$ is connected to the data line 262, and the gate electrode of it is driven by the scanning line 251. When the third thin film transistor $T_3''$ is turned on, the data signal of the data 262 is written into the pixel electrode 24.

In the pixel 20, a liquid crystal capacitor $C_1''$ exists between the pixel electrode 24 and common electrode 27, a Bias-Bending capacitor $C_2''$ exists between the control electrode 23 and pixel electrode 24, and a capacitor $C_3''$ exists between the control electrode 23 and the common electrode 27. Therefore, we obtain the following formula:

$$V_{CE} = \frac{C_2''}{C_2'' + C_3''}(V_{d1} + V_{d3}) + V_{d2},$$

wherein $V_{d1}$, $V_{d2}$ and $V_{d3}$ respectively represents the potentials of pixels, dividedly placed on coordinate (n, m), coordinate (n−1, m−1) and coordinate (n−1, m), to which the data signals are respectively applied. Meantime, we obtain an equation $V_{CE}-V_P=V_{d2}+V_{d3}$ to satisfy Criteria 1 and 2. However, because each of the pixels 20 includes three thin film transistors, only if one of the thin film transistors is damaged, the pixel is considered to be malfunctioning. Therefore, the manufacture yield of this LCD cannot meet an acceptable standard currently. On the other hand, the number of the thin film transistors connected to a same scanning line is too much so as to result in a severe RC delay on the scan signal. The foresaid problems have to be further resolved.

SUMMARY OF THE INVENTION

The first objective of the present invention is to provide a liquid crystal display panel. The polarity of a control electrode synchronously changes with the polarity of the pixel. When the polarity of the pixel is positive, the potential of the control electrode is higher than that of the pixel electrode; when the polarity of pixel is negative, the potential of control electrode is lower than that of the pixel electrode.

The second objective of the present invention is to provide a liquid crystal display panel, of which each pixel includes two thin film transistors. The thin film transistors are accompanied by driving signals to avoid the occurrence of a disclination line.

In order to achieve the objective, the present invention discloses a liquid crystal display panel and a driving method therfor, which includes an active matrix substrate having a plurality of thin film transistors. The active matrix substrate comprises a plurality of parallel scanning lines and a plurality of parallel data lines, which cross mutually and form a plurality of pixels. Each of the pixels includes the first thin film transistor, the second thin film transistor, a control electrode (CE) and a pixel electrode. The first electrode of the first thin film transistor is connected to the data line; the second electrode of it is connected to the pixel electrode; the gate electrode of it is connected to the scanning line. The first electrode of the second thin film transistor is connected to another adjacent data line; the second electrode of it is connected to the control electrode, and the gate of it is connected to another adjacent scanning line. The scanning signals driving the pixel allows the control electrode and the pixel electrode to be written into their potentials during two horizontal scanning periods or during a vertical scanning period respectively.

BRIEF DESCRIPTION OF THE DRAWINGS

The invention will be described according to the appended drawings in which.

PREFERRED EMBODIMENT OF THE PRESENT INVENTION

Figure 1:
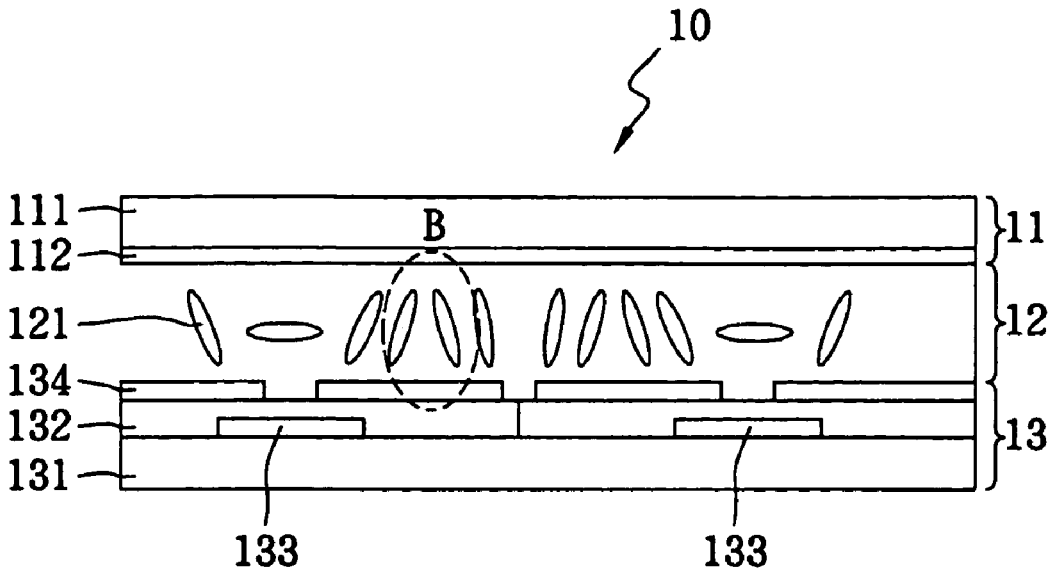
FIG. 1 (Background Art)
FIG. 1 is a cross-sectional diagram of a conventional LCD display panel with a bias-bending vertical alignment (BBVA) type.
Figure 2:
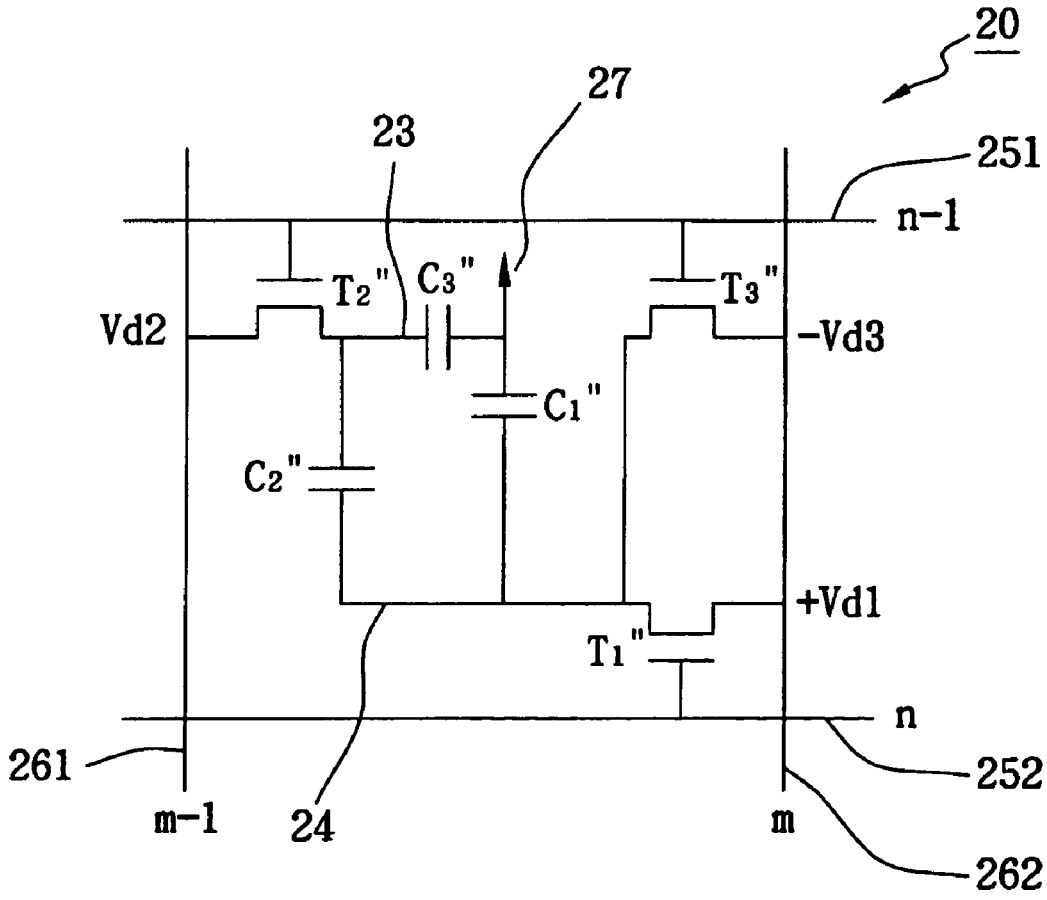
FIG. 2 (Background Art)
FIG. 2 is an equivalent circuit diagram of a pixel proposed by Korean Samsung Electronics Cooperation.
Figure 3:
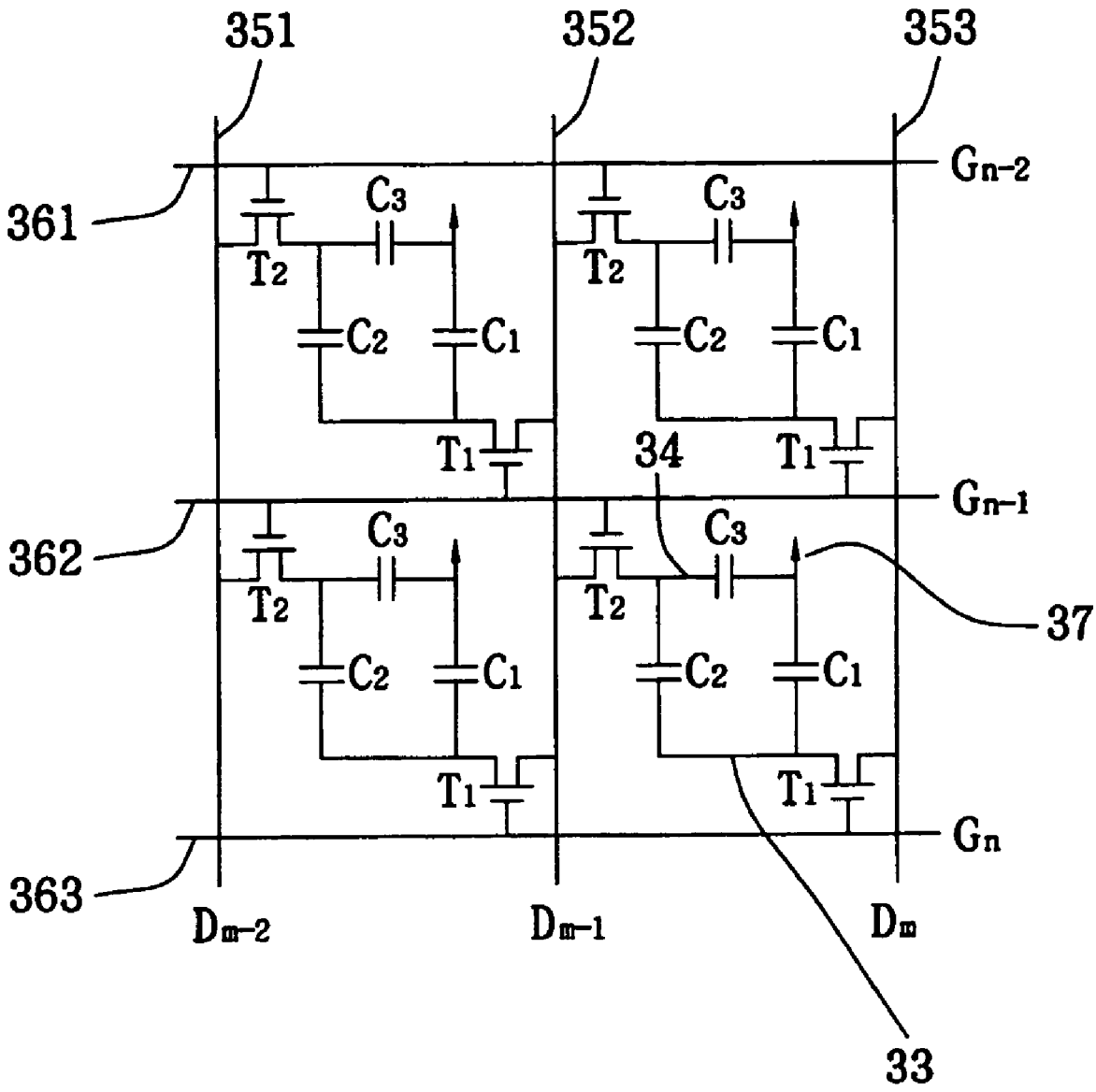
FIG. 3 is an equivalent circuit diagram of the pixel of an LCD panel in accordance with the present invention.

FIG. 3 an equivalent circuit diagram of the pixel of an LCD panel in accordance with the present invention. Only four adjacent pixels are shown in FIG. 3, which are formed by scanning lines 361, 362 and 363 (representing $G_{n-2}$, $G_{n-1}$ and $G_n$ respectively) crossing data lines 351, 352 and 353 (representing $D_{m-2}$, $D_{m-1}$ and $D_m$ respectively). Each pixel includes a first thin film transistor $T_1$, a second thin film transistor $T_2$, a control electrode 34 and a pixel electrode 33 for the pixel at the intersection of the data line 353 and scanning line 363. The first electrode of the first thin film thin film transistor $T_1$ is connected to a data line 353, the second electrode of it is connected to the pixel electrode 33, and the gate electrode of it is connected to a scanning line 363. The first electrode of the second thin film transistor T2 is connected to another adjacent data line 352, the second electrode of it is connected to the control electrode 34, and the gate electrode of it is connected to a scanning line 362. In the pixel configuration of the presented invention, a liquid crystal capacitor $C_1$ exists between the pixel electrode 33 and a common electrode 37, a bias-bending capacitor $C_2$ exists between the control electrode 34 and the pixel electrode 33, and further a capacitor $C_3$ is formed between the control electrode 34 and the common electrode 37.

Figure 4:
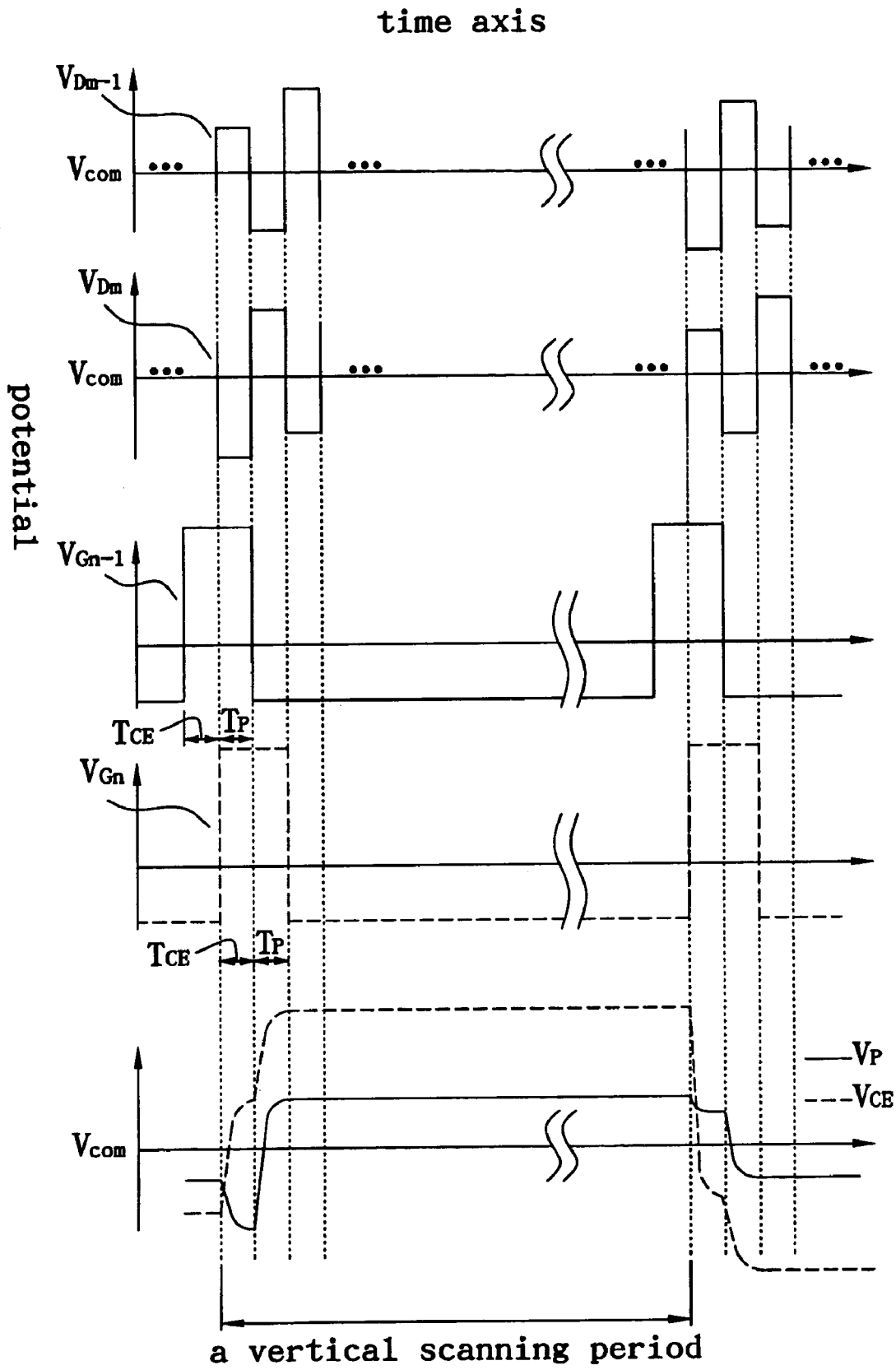
FIG. 4 is a waveform diagram of driving signals applied to the pixel in FIG. 3.

FIG. 4 is a waveform diagram of driving signals applied to the pixel in FIG. 3. $V_{Dm-1}$ and $V_{Dm}$ represent the data signals applied to the data lines 352 and 353, respectively, and $V_{Gn-1}$ and $V_{Gn}$ represent the scan signals applied to the scanning lines 362 and 363, respectively. The scanning waveform during each vertical scanning period includes a first waveform in a $T_{CE}$ interval and a second waveform in a $T_P$ interval.

The waveform the lowest row in FIG. 4 is the variations of the corresponding potentials of the pixel placed at the intersection of the scanning line 363 and the data line 353, wherein $V_P$ and $V_{CE}$ represent the potential of the pixel electrode 33 and control electrode 34, respectively. During the preceding interval $T_{CE}$ on the scanning signal $V_{Gn}$, the second thin film transistor $T_2$ is turned on by the scanning signal $V_{Gn-1}$, and then the data signal $V_{Dm-1}$ is written into the control electrode 34. As shown in FIG. 4, the potential of the control electrode 34 change from an initial potential (lower than $V_{com}$) to the same potential as the data signal $V_{Dm-1}$ (higher than $V_{com}$). At the same time, because the first thin film transistor $T_1$ is turned on by $V_{Gn}$, the potential (lower than $V_{com}$) of the data signal $V_{Dm}$ is written into the pixel electrode 33. During the succeeding interval $T_P$ on the scanning signal $V_{Gn}$, the first thin film transistor $T_1$ is turned on by the scanning signal $V_{Gn}$, and then the potential (higher than $V_{com}$) of the data signal $V_{Dm}$ is written into the pixel electrode 33. Meanwhile, because the second thin film transistor $T_2$ is turned off, the control electrode 34 is in a floating state, while the potential of the control electrode 34 is advanced to a higher level due to a capacitively coupled effect.

From FIG. 4, it is clear that when the polarity of the pixel is positive, Criterion 1 $V_{CE}>V_P>V_{com}$ is satisfied. After the vertical scanning period terminating, because the polarity of the pixel changes to negative, Criterion 2 $V_{CE}<V_P<$Vcom is also satisfied accordingly.

Figure 5:
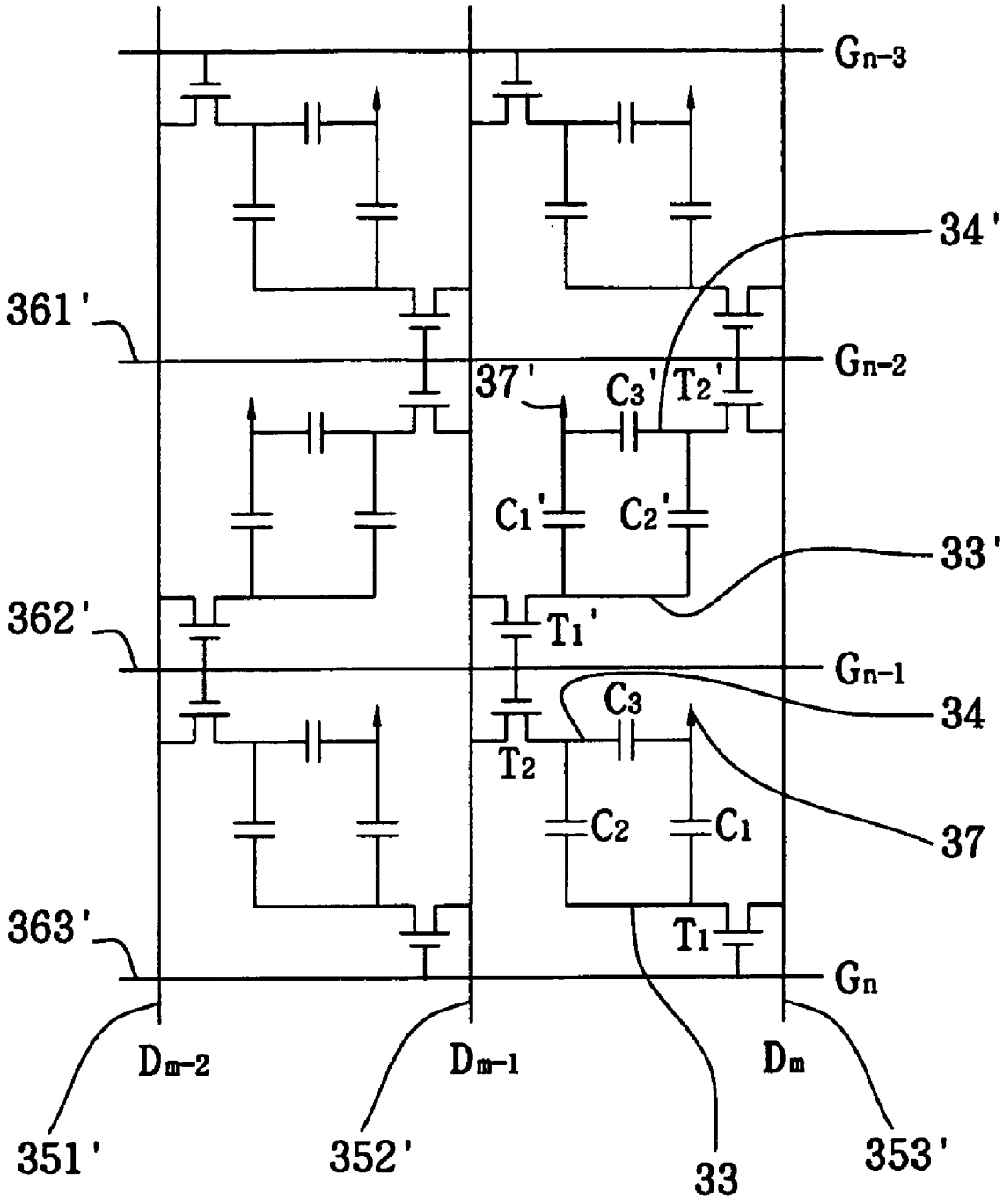
FIG. 5 is an equivalent circuit diagram of the pixel of an LCD panel in accordance with another embodiment of the present invention.

FIG. 5 is an equivalent circuit diagram of the pixel of an LCD panel in accordance with another embodiment of the present invention. The configuration of the pixel connected to a scanning line 363' is given as following: the first electrode of the first thin film transistor $T_1$ is connected to a data line 353', the second electrode of it is connected to a pixel electrode 33, and the gate electrode of it is connected to a scanning line 363'; the first electrode of the second thin film transistor $T_2$ is connected to another adjacent data line 352', the second electrode of it is connected to a control electrode 33, and the gate electrode of it is connected to a scanning line 362'. As the configuration in FIG. 5 shows, a liquid crystal capacitor $C_1$ exists between the pixel electrode 33 and a common electrode 37, a bias-bending capacitor $C_2$ exists between the control electrode 34 and the pixel electrode 33, and further a capacitor $C_3$ is formed between the control electrode 34 and the common electrode 37.

The configuration of the pixel connected to the scanning line 362' is horizontally symmetric to the configuration of the pixel connected to the scanning line 363', and is given as follows: the first electrode of the first thin film transistor $T_1'$ is connected to the data line 352', the second electrode of it is connected to a pixel electrode 33', and the gate electrode of it is connected to the scanning line 362'; the first electrode of the second thin film transistor $T_2'$ is connected to another adjacent data line 353', the second electrode of it is connected to a control electrode 34', and the gate electrode of it is connected to a scanning line 361'. A liquid crystal capacitor $C_1'$ exists between the pixel electrode 33' and a common electrode 37', a bias-bending capacitor $C_2'$ exists between the control electrode 34' and the pixel electrode 33', and further a capacitor $C_3'$ is formed between the control electrode 34' and the common electrode 37'.

Figure 6:
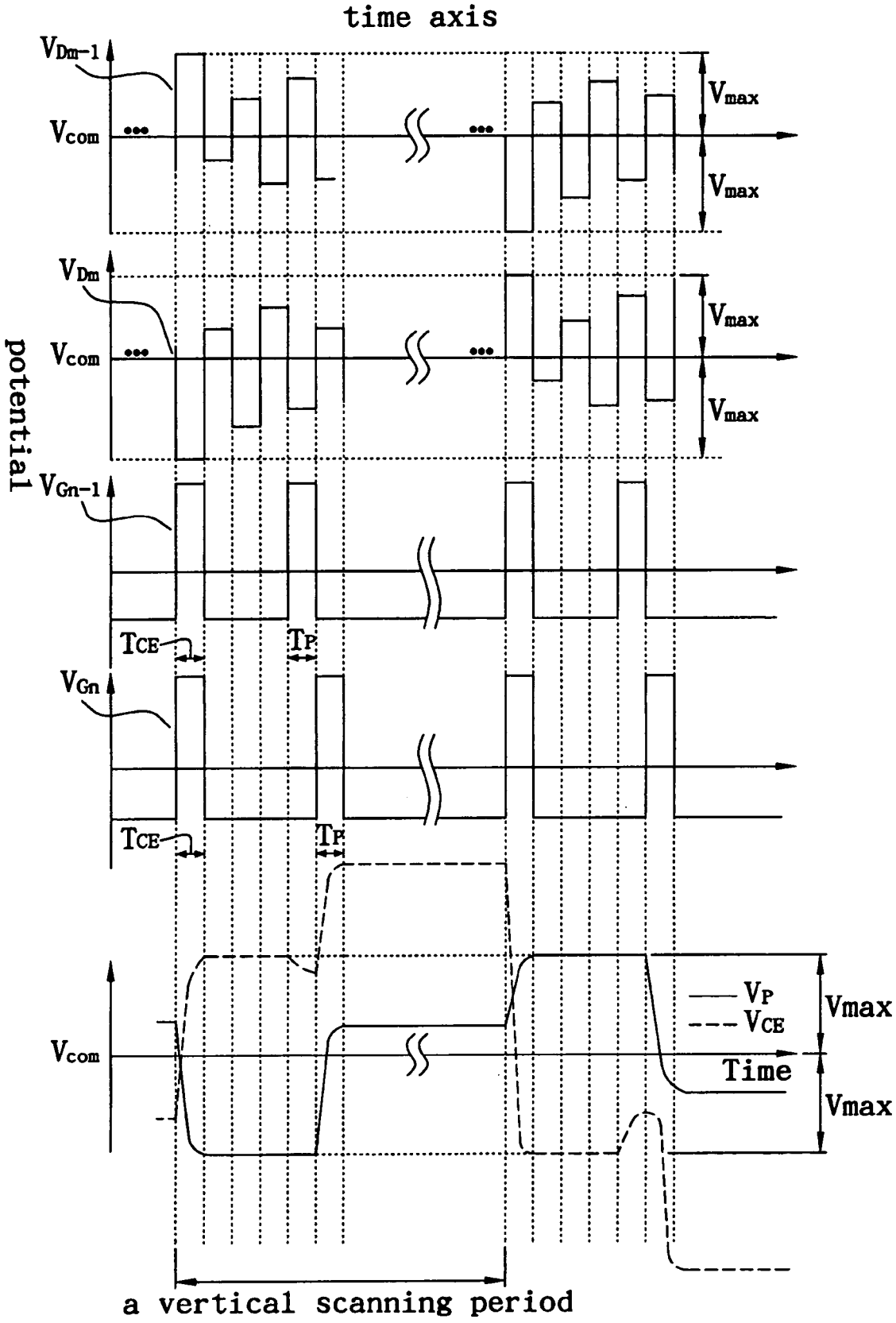
FIG. 6 is a waveform diagram of driving signals applied to the pixel in FIG. 5.

FIG. 6 is a waveform diagram of driving signals applied to the pixel in FIG. 5. $V_{Dm-1}$ and $V_{Dm}$ represent the data signals applied to the data lines 352' and 353', respectively, and $V_{Gn-1}$ and $V_{Gn}$ represent the scan signals applied to the scanning lines 362' and 363', respectively. The scanning waveform during a vertical scanning period includes two parts. That is, the data signals $V_{Dm-1}$ and $V_{Dm}$ are respectively written into the control electrode 34 and 34' during an interval $T_{CE}$, and the data signals $V_{Dm}$ and $V_{Dm-1}$ are respectively written into the pixel electrodes 33 and 33' during an interval $T_P$.

The first pulses of the scanning signals $V_{Gn}$ and $V_{Gn-1}$ are active at the same horizontal scanning period, which is equal to the interval $T_{CE}$. When the potential of $V_{Dm-1}$ is higher than that of $V_{com}$, the data signal $V_{Dm-1}$ is allowed to be written into the control electrode 34 after the second thin film transistor $T_2$ is turned on. Meanwhile, the potential of $V_{Dm-1}$ is equal to $V_{com}$ plus $V_{max}$ representing the maximum voltage between the potential of the data signals and the potential of the common electrode. Therefore, the potential of the control electrode 34 changes to a higher level the same as that of the data signal $V_{Dm-1}$ from a lower level. Meanwhile, the potential of data signal $V_{Dm}$ is at a lower level, and the data signal $V_{Dm}$ is also written into the pixel electrode 33, wherein the potential of $V_{Dm}$ is equal to $V_{com}$ minus $V_{max}$.

The second pulses of the scanning signals $V_{Gn-1}$ and $V_{Gn}$ are respectively active at two adjacent horizontal scanning periods, i.e., the intervals $T_P$. The high potential of the second pulse on the scanning signal $V_{Gn-1}$ turns on the second thin film transistor $T_2$; meanwhile, the potential of the data signal $V_{Dm-1}$ is written into the control electrode 34. Then the high potential of the second pulse on the scanning signal $V_{Gn}$ turns on the first thin film transistor $T_1$; meanwhile, the high potential of the data signal $V_{Dm}$ is written into the pixel electrode 33. Because the second thin film transistor $T_2$ is turned off at this time, the control electrode 34 is in a floating state; consequently, the potential $V_{CE}$ of the control electrode 34 advanced to a higher level due to a capacitively coupled effect. Because the capacitance of the capacitor $C_3$ is far less than that of that of the capacitors $C_1$ and $C_2$, for the pixels placed at the intersection of the scan line 363' and the data line 353', a formula is given as follows:

$$V_{CE} - V_P \cong \pm \frac{(C_1 + 2C_2)V_{\max} + C_1 \times |V_{Pn-1}|}{C_1 + C_2},$$

wherein $V_{max}$ represents the maximum voltage between the potential of the data signals and the potential of the common electrode, and $V_{Pn-1}$ represents the voltage of the pixel electrode at the intersection of the scanning line 362' and the data line 352' against the potential $V_{com}$.

From FIG. 6, it is clear that when the polarity of pixel is positive, except for an ignorable interval, Criterion 1 $V_{CE}>V_P>V_{com}$ is satisfied during most of the remaining period. After a vertical scanning period terminating, the polarity of the pixel changes to negative, then Criterion 2 $V_{CE}<V_P<V_{com}$ is satisfied during most of another vertical scanning period.

The whole screen of the LCD panel can be divided into several groups according to the scanning lines, and each group has several adjacent scan lines, such as two, three and four adjacent scanning lines. The intervals $T_{CE}$ of the scanning lines in the same group appear on the same horizontal scanning period.

The above-described embodiments of the present invention are intended to be illustrative only. Numerous alternative embodiments may be devised by persons skilled in the art without departing from the scope of the following claims.

What is claimed is:

1. A liquid crystal display panel, comprising:

a plurality of scanning lines;

a plurality of data lines; and a plurality of pixels formed at respective intersections of the scanning lines and data lines, each of the pixels including:

a pixel electrode;

a control electrode;

a first thin film transistor having a gate electrode connected to a first scanning line among the scanning lines, a first electrode connected to a first data line among the data lines, and a second electrode connected to the pixel electrode; and a second thin film transistor having a gate electrode connected to a second scanning line adjacent to the first scanning line, a first electrode connected to a second data line adjacent to the first data line, and a second electrode connected to the control electrode;

wherein the first thin film transistor and the second thin film transistor of the pixel are turned on together during a first duration in a vertical scanning period.

2. The liquid crystal display panel of claim 1, wherein a portion of a scanning signal of the first scanning line for a pixel and a portion of a scanning signal of the second scanning line for the same pixel are simultaneously active during the first duration.

3. The liquid crystal display panel of claim 1, wherein each of scanning signals of the first scanning line and the second scanning line comprises a first portion and a second portion which are active in the vertical scanning period, wherein the first portion is prior to the second portion.

4. The liquid crystal display panel of claim 3, wherein the first portion and the second portion are included in a pulse.

5. The liquid crystal display panel of claim 3, wherein the first portion and the second portion are two individual pulses.

6. The liquid crystal display panel of claim 3, wherein the first portion of the scanning signal of the first scanning line and the first portion of the scanning signal of the second scanning line are simultaneously active during the first duration in the vertical scanning period.

7. The liquid crystal display panel of claim 6, wherein a polarity of a data signal of the first data line is opposite to a polarity of a data signal of the second data line during the first duration.

8. The liquid crystal display panel of claim 7, wherein the polarity of a data signal of the first data line during a second duration at which the second portion of the scanning signal of the first scanning line exists is the same as the polarity of a data signal of the second data line during the first duration.

9. The liquid crystal display panel of claim 8, wherein a potential of the control electrode is higher than a potential of the pixel electrode during the second duration when the polarity of the pixel is positive.

10. The liquid crystal display panel of claim 8, wherein a potential of the control electrode is lower than a potential of the pixel electrode during the second duration when the polarity of the pixel is negative.

11. The liquid crystal display panel of claim 3, wherein the first portion of the scanning signal of the first scanning line and the second portion of the scanning signal of the second scanning line are simultaneously active during the first duration in the vertical scanning period.

12. The liquid crystal display panel of claim 11, wherein a polarity of a data signal of the first data line is opposite to a polarity of a data signal of the second data line during the first duration.

13. The liquid crystal display panel of claim 12, wherein the polarity of a data signal of the first data line during a third duration at which the second portion of the scanning signal of the first scanning line exists is the same as the polarity of a data signal of the second data line during the first duration.

14. The liquid crystal display panel of claim 13, wherein a potential of the control electrode is higher than a potential of the pixel electrode during the third duration when the polarity of the pixel is positive.

15. The liquid crystal display panel of claim 13, wherein a potential of the control electrode is lower than a potential of the pixel electrode during the third duration when the polarity of the pixel is negative.

16. The liquid crystal display panel of claim 1, wherein the gate electrode of the first thin film transistor of a pixel located in a pixel row is electrically connected to the gate electrode of the second thin film transistor of another pixel located in a next pixel row.

17. The liquid crystal display panel of claim 16, wherein a portion of a scanning signal of the first scanning line for the pixel and a portion of a scanning signal of the second scanning line for the same pixel are simultaneously active during the first duration.

18. The liquid crystal display panel of claim 17, wherein the first portion and the second portion are two individual pulses.

19. The liquid crystal display panel of claim 17, wherein the first portion of the scanning signal of the first scanning line and the first portion of the scanning signal of the second scanning line are simultaneously active during the first duration in the vertical scanning period.

20. The liquid crystal display panel of claim 19, wherein a polarity of a data signal of the first data line is opposite to a polarity of a data signal of the second data line during the first duration.

21. The liquid crystal display panel of claim 20, wherein the polarity of a data signal of the first data line during a second duration at which the second portion of the scanning signal of the first scanning line exists is the same as the polarity of a data signal of the second data line during the first duration.

22. The liquid crystal display panel of claim 21, wherein a potential of the control electrode is higher than a potential of the pixel electrode during the second duration when the polarity of the pixel is positive.

23. The liquid crystal display panel of claim 21, and a potential of the control electrode is lower than a potential of the pixel electrode during the second duration when the polarity of the pixel is negative.

* * * * *